US010394181B2

(12) United States Patent
Takei

(10) Patent No.: US 10,394,181 B2
(45) Date of Patent: Aug. 27, 2019

(54) IMAGE FORMING APPARATUS FRAME

(71) Applicant: CANON KABUSHIKI KAISHA, Tokyo (JP)

(72) Inventor: Yuhei Takei, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/976,203

(22) Filed: May 10, 2018

(65) Prior Publication Data

US 2018/0259897 A1 Sep. 13, 2018

Related U.S. Application Data

(63) Continuation of application No. 15/242,823, filed on Aug. 22, 2016.

(30) Foreign Application Priority Data

Aug. 28, 2015 (JP) ..... 2015-169069

(51) Int. Cl.
*G03G 21/16* (2006.01)
*G03G 21/18* (2006.01)

(52) U.S. Cl.
CPC ..... *G03G 21/1619* (2013.01); *G03G 21/1647* (2013.01); *G03G 21/1842* (2013.01)

(58) Field of Classification Search
CPC ..... G03G 21/1619; G03G 21/1647; G03G 21/1842; G03G 2215/0132; G03G 2221/1684
See application file for complete search history.

(56) References Cited

U.S. PATENT DOCUMENTS

2007/0230996 A1 10/2007 Saito et al.
2008/0007935 A1* 1/2008 Kondo ..... B41J 29/02 361/829

(Continued)

FOREIGN PATENT DOCUMENTS

CN 101105664 A 1/2008
CN 101291382 A 10/2008

(Continued)

OTHER PUBLICATIONS

Japanese Office Action issued in corresponding Japanese Application No. 2015169069 dated May 28, 2019.

(Continued)

*Primary Examiner* — Walter L Lindsay, Jr.
*Assistant Examiner* — Jessica L Eley
(74) *Attorney, Agent, or Firm* — Venable LLP

(57) ABSTRACT

The image forming member has a frame member which forms the image forming member, the frame member including: a first support member, the first support member having a first member and a second member which is attached to the first member, a part of the second member being outside of the first member in a longitudinal direction of the first support member, a second plate member being fixed to a first plate member so that a length of the first support member in a longitudinal direction becomes a predetermined length; a second support member which is fastened to the first plate member by welding; and a third support member which is fastened to the second plate member by welding. Thereby, the image forming member can form images with high accuracy.

6 Claims, 13 Drawing Sheets

(56) References Cited

U.S. PATENT DOCUMENTS

| | | | | |
|---|---|---|---|---|
| 2008/0075502 | A1* | 3/2008 | Tada | G03G 21/1619 399/111 |
| 2008/0252946 | A1 | 10/2008 | Kang | |
| 2010/0014886 | A1 | 1/2010 | Lee et al. | |
| 2013/0330100 | A1* | 12/2013 | Funayama | G03G 21/1619 399/107 |
| 2014/0356021 | A1 | 12/2014 | Sato | |
| 2015/0220047 | A1* | 8/2015 | Suzuki | G03G 21/1619 399/107 |
| 2016/0195844 | A1* | 7/2016 | Takei | G03G 21/1619 312/223.1 |
| 2017/0060076 | A1* | 3/2017 | Takei | G03G 21/1619 |

FOREIGN PATENT DOCUMENTS

| | | | |
|---|---|---|---|
| CN | 105759584 | A | 7/2016 |
| JP | S61-141902 | U | 9/1986 |
| JP | H09-146321 | A | 6/1997 |
| JP | 11-017865 | A | 1/1999 |
| JP | 2000-061746 | A | 2/2000 |
| JP | 2000-082881 | A | 3/2000 |
| JP | 2003-066671 | A | 3/2003 |
| JP | 2003-080217 | A | 3/2003 |
| JP | 2005-250014 | A | 9/2005 |
| JP | 2007279229 | A | 10/2007 |
| JP | 2010-204247 | A | 9/2010 |
| JP | 2015-163959 | A | 9/2015 |

OTHER PUBLICATIONS

Chinese Office Action issued in corresponding Chinese Application No. 201610724035.9 dated May 31, 2019.

* cited by examiner

IMAGE FORMING APPARATUS FRAME

CROSS-REFERENCE TO RELATED APPLICATION

This application is a continuation of U.S. patent application Ser. No. 15/242,823, filed Aug. 22, 2016, which claims priority to Japanese Application No. 2015-169069, filed on Aug. 28, 2015, both of which are herein incorporated by reference in their entireties.

BACKGROUND OF THE INVENTION

Field of the Invention

The present invention relates to an image forming member of a printer, a facsimile machine, a copier, a multifunction peripheral having a combination of these functions in combination, or the like.

Description of the Related Art

For positioning in front, back, left and right sides of a frame member, which constitutes a main body of an image forming member, a positioning member is provided between front and back side plates of the main body of the image forming member, and the positioning precision of front, back, left and right sides of the frame member of the main body of the image forming member is secured by the dimensional precision of the positioning member.

For instance, as is illustrated in FIG. 6 of Japanese Patent Application Laid-Open No. 2010-204247, the frame member is structured so that bent portions are provided in this side and a rear side of a stay 110, and the bent portions are fastened to front and back side plates 121 and 122, respectively. Generally, a tolerance (difference between maximum value and minimum value) of a length dimension on the outside of the bent portion of the stay 110 which has the length dimension of approximately 500 mm is approximately ±0.5 mm to 0.7 mm.

In recent years, the frame member has been assembled not with conventional screw fastening but with laser welding, in order to increase the precision and reduce the cost of the frame member which constitutes the main body of the image forming member. In the case where the frame member is assembled with the laser welding, if a gap between components which are subjected to the laser welding becomes large to a certain extent or more, there is a possibility that welding failure may occur.

As in Japanese Patent Application Laid-Open No. 2010-204247, in the case where the stay 110 is fastened to the front and back side plates 121 and 122 of the main body of the image forming member, the front and back side plates 121 and 122 of the main body of the image forming member may fall or be deformed because of dispersion of the tolerance of the length dimension of the stay 110. Because of this, it has been difficult to mass-produce a highly precise frame member, which constitutes the main body of the image forming member.

SUMMARY OF THE INVENTION

An object of the present invention is to provide an image forming member that can reduce a deformation of a frame member, which is caused by welding, originating in a dimension failure of a stay.

Another object of the present invention is to provide an image forming member which forms an image on a recording material, the image forming member including: a frame member which forms the image forming member, the frame member having a first support member, the first support member having a first member and a second member which is attached to the first member, a part of the second member being outside of the first member in a longitudinal direction of the first support member, a second plate member being fixed to a first plate member so that a length of the first support member in the longitudinal direction becomes a predetermined length; a second support member which is fastened to the first plate member by welding; and a third support member which is fastened to the second plate member by welding.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

One embodiment of the image forming member according to the present invention will be specifically described.

<Image Forming Member>

Figure 1:
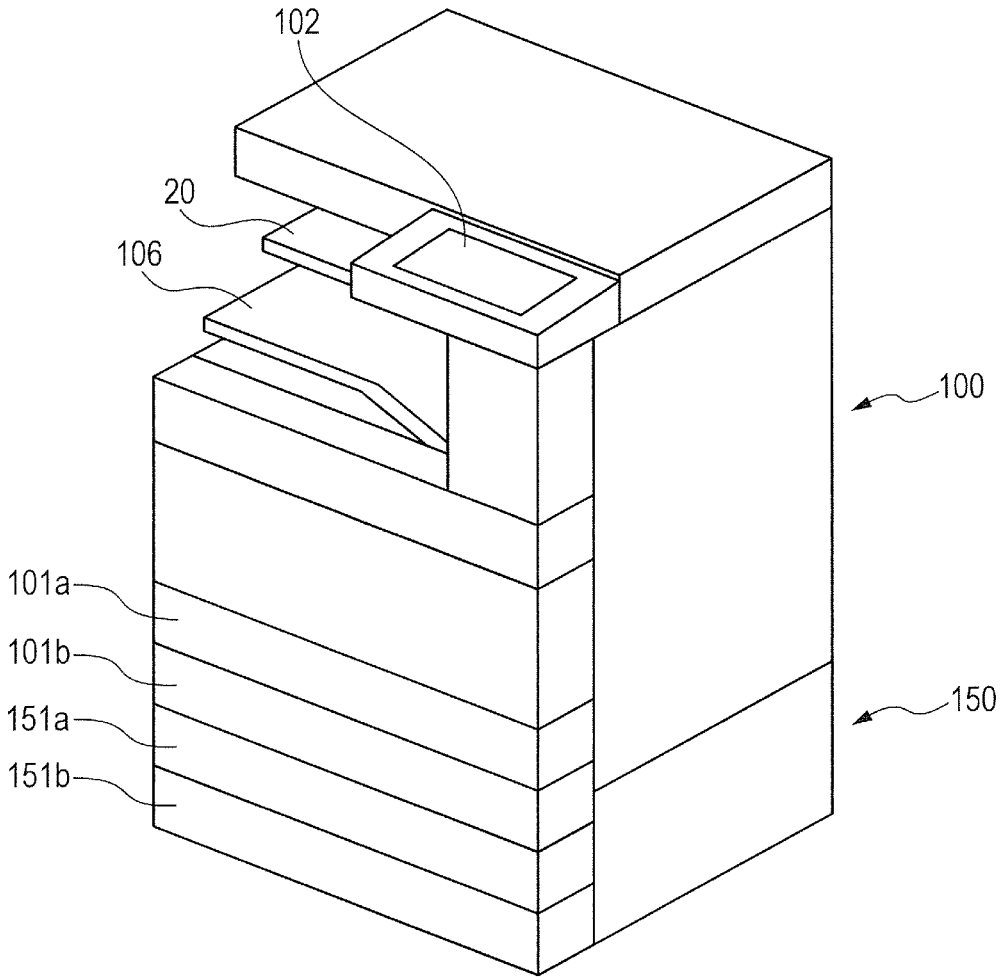
FIG. 1 is an explanatory perspective view illustrating a structure of an image forming member according to the present invention.
Figure 2:
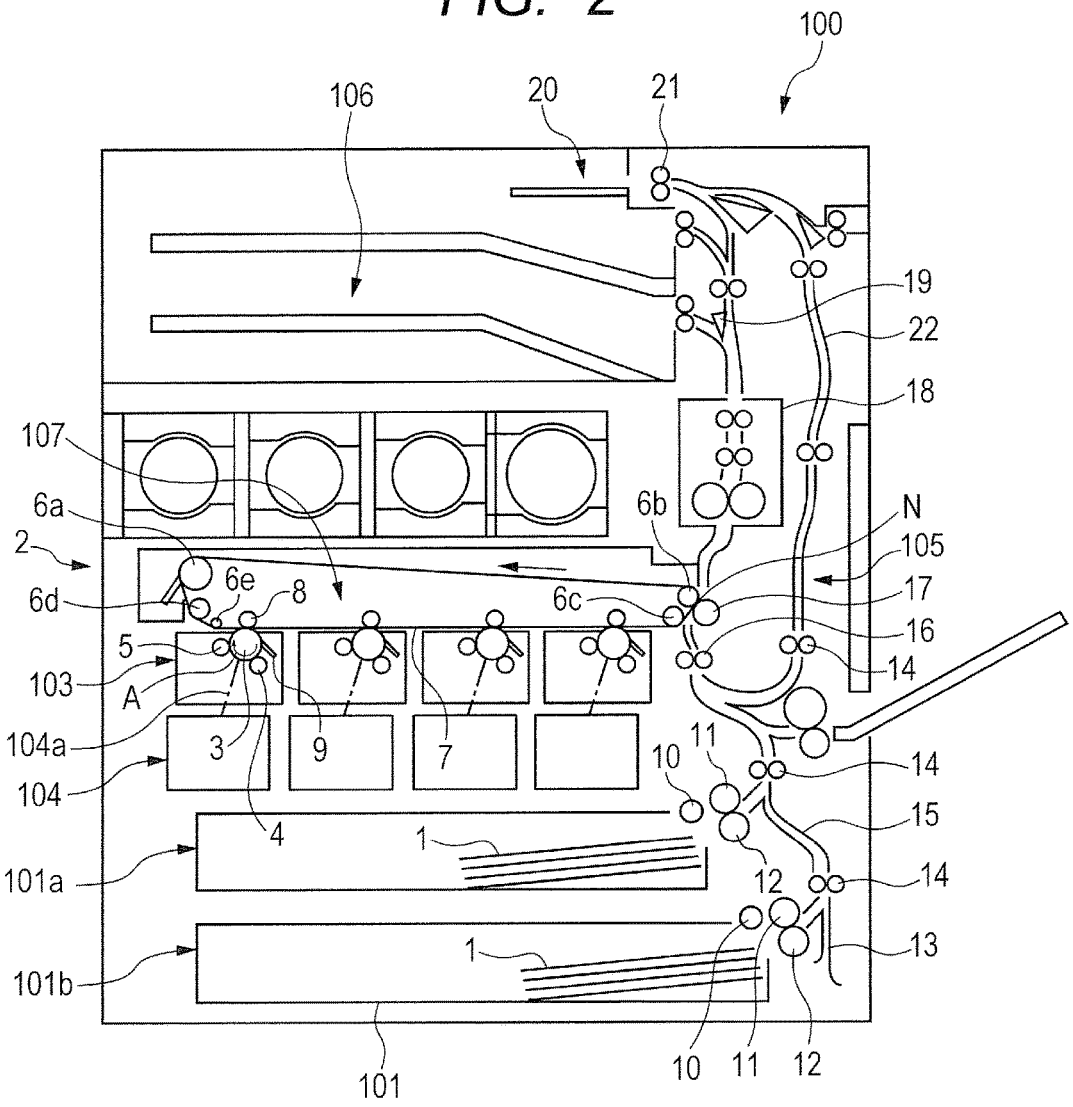
FIG. 2 is an explanatory cross-sectional view illustrating the structure of the image forming member according to the present invention.

The structure of the image forming member according to the present invention will be described below with reference to FIG. 1 and FIG. 2. FIG. 1 is an explanatory perspective view illustrating the structure of the image forming member according to the present invention. FIG. 2 is an explanatory cross-sectional view illustrating the structure of the image forming member according to the present invention. A main body of an image forming member 100 (main body of image forming member) illustrated in FIG. 1 and FIG. 2 can be mounted on an optional feeding module 150, as is illustrated in FIG. 1. The main body of the image forming member 100 and the optional feeding module 150 have two stages of feeding cassettes 101*a* and 101*b*, and 151*a* and 151*b*, in upper and lower sides, respectively.

Each of the feeding cassettes 101*a*, 101*b*, 151*a* and 151*b* accommodates a recording material 1 having a different size and a basis weight from the others. A user can select the recording material 1 to be used, through an operation portion 102 illustrated in FIG. 1, an unillustrated personal computer or the like which is connected to the image forming member 100.

Figure 3:
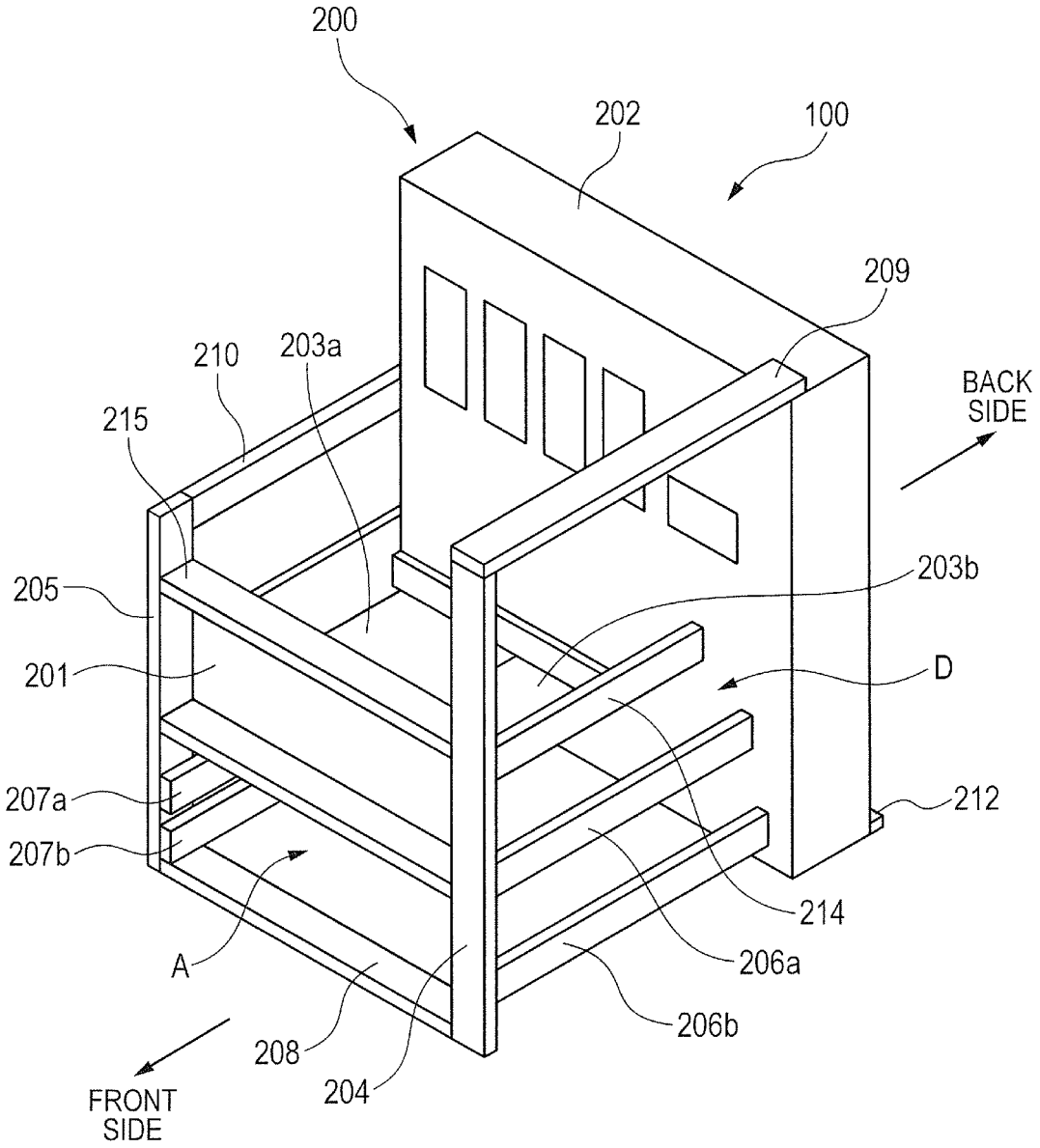
FIG. 3 is an explanatory perspective view illustrating a structure of a frame member at the time when a main body of the image forming member in an embodiment is viewed from a front side.
Figure 4:
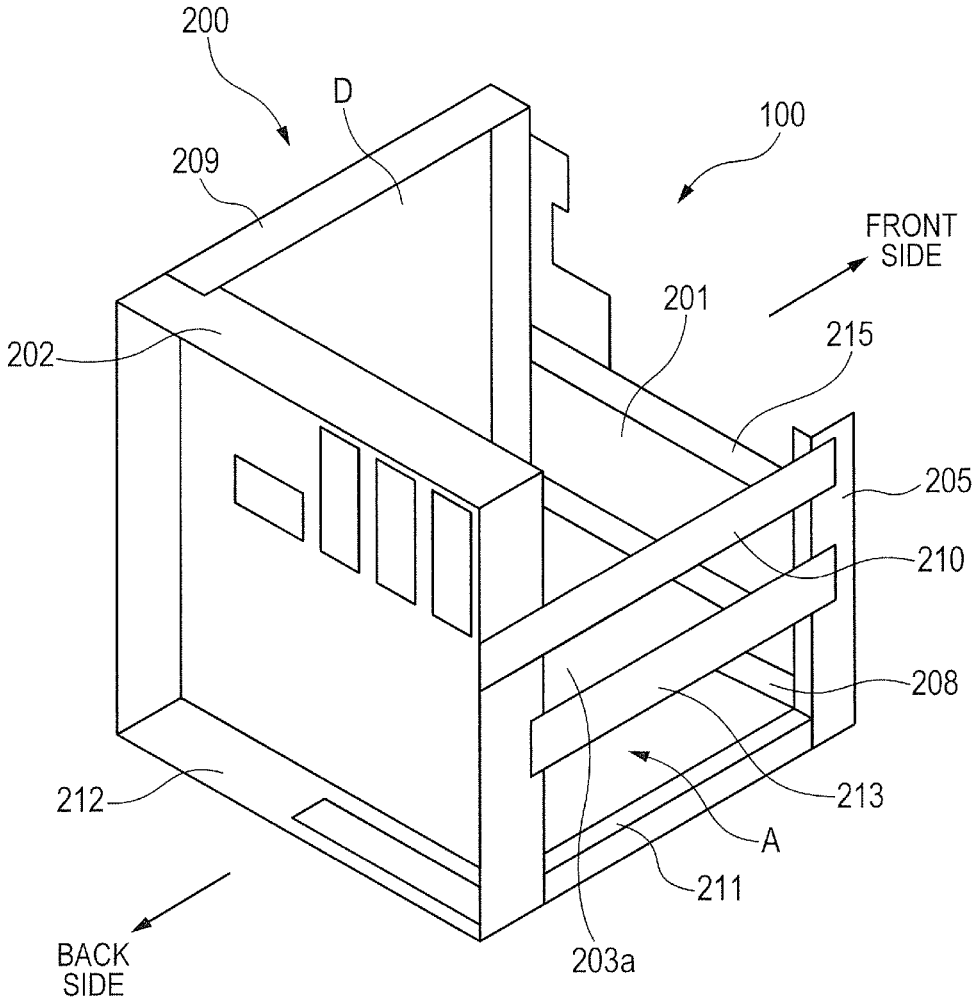
FIG. 4 is an explanatory perspective view illustrating a structure of the frame member at the time when the main body of the image forming member in the embodiment is viewed from a back side.

As is illustrated in FIG. 2, an image forming section 2 is provided in the main body of the image forming member 100. When the frame member 200, which forms the main body of the image forming member 100 illustrated in FIG. 3 and FIG. 4, is distorted, an image failure and/or an operation failure may occur in the image forming section 2. On the other hand, in the optional feeding module 150 in FIG. 1, even though the frame member 200 has been slightly distorted, the distortion does not affect a function of feeding the recording material 1 from the feeding cassettes 151*a* and 151*b*, and delivering the recording material 1 to the main body of the image forming member 100.

The recording material 1 which has been fed from the feeding cassettes 101*a* or 101*b* illustrated in FIG. 2 is conveyed in the upward direction in FIG. 2, through a conveyance path 105 which is a conveyance section and is provided in the right side of the main body of the image forming member 100 illustrated in FIG. 2. After having the image formed thereon in the image forming section 2, the recording material 1 is ejected onto an ejection tray 106.

<Image Forming Section>

The image forming sections 2 each have a photosensitive drum 3 provided therein, which is an image carrying body rotating in a clockwise direction in FIG. 2. Charging rollers 4, which are each a charging unit that uniformly charges the surface of the photosensitive drum 3, are provided in the peripheries of the respective photosensitive drums 3. Furthermore, laser scanners 104 (are provided therein). The laser scanners 104 are each an image exposure unit that irradiates the surface of the photosensitive drum 3, which has been uniformly charged by the charging roller 4, with a laser beam 104*a* according to image information to form electrostatic latent images.

Furthermore, developing rollers 5, which are developer carrying bodies, are provided therein. The developing rollers 5 are each provided in a developing apparatus that is a developing unit supplying a toner which is a developer for the electrostatic latent image formed on the surface of the photoconductive drum 3. The image forming sections 2 in the present embodiment are each provided for colors of yellow Y, magenta M, cyan C and black Bk, respectively, from the left side in FIG. 2.

Furthermore, an outer peripheral surface of an intermediate transfer belt 7, which is stretched by tension rollers 6*a* to 6*e* so as to be capable of rotating in a counter-clockwise direction in FIG. 2, is provided to face the surface of the photosensitive drum 3 for each of the colors. Primary transfer rollers 8, which are each a primary transfer unit that faces the photosensitive drum 3 of each of the colors through the intermediate transfer belt 7, are provided in the inner peripheral surface side of the intermediate transfer belt 7.

Furthermore, the toner which has remained on the surface of the photosensitive drum 3 after having been transferred is scraped out and removed by a cleaning blade 9, which is a cleaning unit that is provided on a cleaning apparatus.

An image forming unit 103 in the present embodiment has the photoconductive drum 3, the charging roller 4, and an unillustrated developing apparatus in which the developing roller 5 is provided. Furthermore, the unillustrated cleaning apparatus in which the cleaning blade 9 is provided and the like are provided in an integral form. The image forming units 103 each include a process cartridge for each of the colors, which is mounted so as to be attachable to and removable from the main body of the image forming member 100.

The image forming section 2 is configured to have the image forming units 103, a transfer unit 107 which has an intermediate transfer belt 7 and primary transfer rollers 8 provided therein, a second transfer roller 17, a fixing apparatus 18 and others.

<Conveyance Section>

A recording material 1 which has been accommodated in each of the feeding cassettes 101*a*, 101*b*, 151*a* and 151*b* is fed by the feeding roller 10. The recording materials 1 which have been paid out by the feeding roller 10 are separated from each other and fed one by one by collaboration between a feed roller 11 and a retard roller 12.

The recording materials 1 which are accommodated in each of the feeding cassettes 151*a* and 151*b* in the optional feeding module 150 illustrated in FIG. 1 are also similarly fed, and are delivered to a receiving section 13 which is provided in a main body side of the image forming member 100. The recording material 1 which has been fed one by one after having been separated from the others by collaboration between the feed roller 11 and the retard roller 12 is guided by a conveyance guide 15 while being sandwiched and conveyed by conveyance rollers 14, and is conveyed toward a registration roller 16.

An apical portion of the recording material 1, which is sandwiched and conveyed by the conveyance rollers 14, abuts on a nipping portion of the registration roller 16, and a skew of the recording material 1 is corrected by the resiliency of the recording material 1. The recording material 1, of which the skew has been corrected, is sandwiched and conveyed by the registration rollers 16 at predetermined timing, and is conveyed to a second transfer nipping portion N where the outer peripheral surface of the intermediate transfer belt 7 abuts on the second transfer roller 17, which is a second transfer unit.

On the other hand, the surface of the photosensitive drum 3 which has been uniformly charged by the charging roller 4 is irradiated with the laser beam 104*a* which has been emitted from the laser scanner 104 and corresponds to the image information, and the electrostatic latent image is formed thereon. After that, the toners of each of the colors are supplied onto the electrostatic latent images by the developing rollers 5, and the electrostatic latent images are developed as toner images.

The toner images of each of the colors, which have been formed on the surfaces of each of the photoconductive drums 3, are primarily transferred while being sequentially superimposed, on the outer peripheral surface of the intermediate transfer belt 7 that rotates in the counter-clockwise direction in FIG. 2, by the respective primary transfer rollers 8. The recording material 1 is conveyed so as to reach the second transfer nipping portion N by the registration roller 16, in synchronization with a timing at which the toner image that has been superimposed on the outer peripheral surface of the intermediate transfer belt 7 reaches the secondary transfer nipping portion N.

Then, the toner images which have been superimposed on the outer peripheral surface of the intermediate transfer belt 7 are secondarily transferred onto the recording material 1 by the second transfer roller 17. After that, the recording material 1 is heated and pressurized in a process of being sandwiched and conveyed by a fixing roller and a pressurizing roller which are provided on the fixing apparatus 18 that is a fixing unit, and the toner images are thermally fused, and are heat-fixed on the recording material 1. After that, the rotating position of a flapper 19 is changed, and thereby the recording material 1 having the toner image fixed thereon is ejected onto the ejection tray 106. Alternatively, the recording material 1 having the toner image fixed thereon is conveyed to a reversing portion 20, then reversing rollers 21 are inversely rotated, and the recording material 1 is conveyed to a double-sided path 22.

The front and rear surfaces of the recording material 1 which has been conveyed to the double-sided path 22 are reversed in a process that the recording material 1 is conveyed in the double-sided path 22. After that, the recording material 1 is conveyed to the secondary transfer nipping portion N by the registration roller 16 again, and the toner images which have been superimposed on the outer peripheral surface of the intermediate transfer belt 7 are secondarily transferred also onto a second surface of the recording material 1 in a similar way. After that, the toner image is fixed on the recording material 1 by the fixing apparatus 18 again, and the recording material 1 is ejected onto the ejection tray 106.

<Frame Member>

Figure 5:
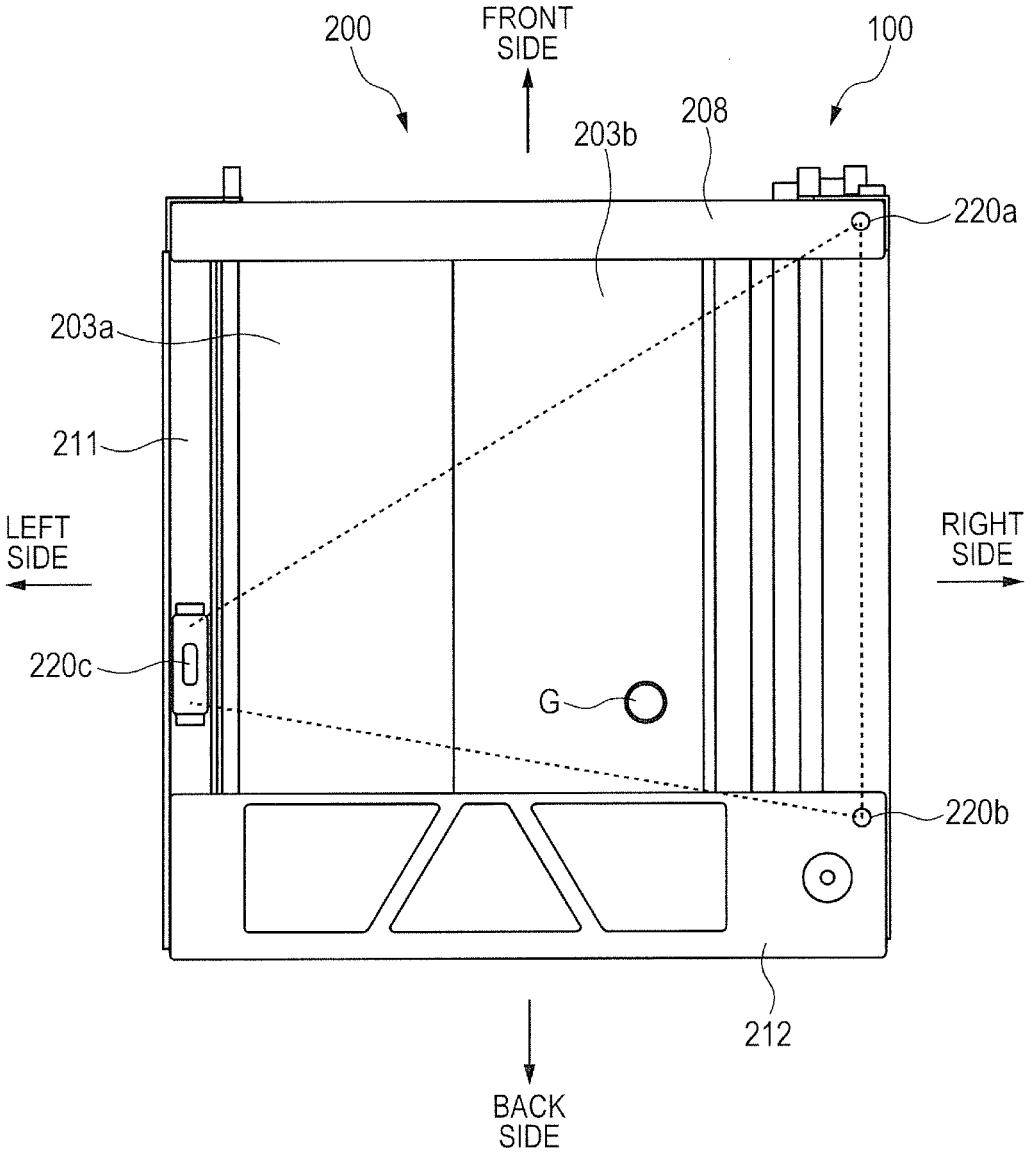
FIG. 5 is an explanatory bottom view illustrating a structure of the frame member at the time when the main body of the image forming member in the embodiment is viewed from a bottom face side.

Next, a structure of a frame member of the main body of the image forming member 100 will be described below with reference to FIG. 3 to FIG. 5. FIG. 3 is an explanatory perspective view illustrating a structure of a frame member 200 at the time when the main body of the image forming member 100 in the present embodiment is viewed from a front side. FIG. 4 is an explanatory perspective view illustrating a structure of the frame member 200 at the time when the main body of the image forming member 100 in the present embodiment is viewed from a back side. FIG. 5 is an explanatory bottom view illustrating a structure of the frame member 200 at the time when the main body of the image forming member 100 in the present embodiment is viewed from a bottom face side.

As are illustrated in FIG. 3 to FIG. 5, the frame member 200 of the main body of the image forming member 100 in the present embodiment has a front face plate 201 and a back face plate 202. Furthermore, the frame member 200 has main bases 203*a* and 203*b* which connect the front face plate 201 with the back face plate 202, and also mount the laser scanners 104 thereon.

Furthermore, as is illustrated in FIG. 3, the frame member 200 has a right column 204 (a second stay) which is a column member and is a second support member that supports a right end portion at the time when the image forming member 100 has been viewed from the front side (this side in FIG. 3) of the front face plate 201, and that extends in a lower direction in FIG. 3 to the vicinity of an installation surface of the main body of the image forming member 100. Furthermore, as is illustrated in FIG. 3, the frame member 200 has a left column 205 (a third stay) which is a column member and is a third support member that supports a left end portion at the time when the image forming member 100 has been viewed from the front side (this side in FIG. 3) of the front face plate 201, and that extends in the lower direction in FIG. 3 to the vicinity of an installation surface of the main body of the image forming member 100.

Furthermore, as is illustrated in FIG. 3, the frame member 200 has a first lower right stay 206*a* and a second lower right stay 206*b* which limit positions in a depth direction of the right column 204 and the rear face plate 202, in the vicinity of the installation surface of the main body of the image forming member 100. The first lower right stay 206*a* and the second lower right stay 206*b* serve as a rail member for guiding the feeding cassettes 101*a* and 101*b* when the cassettes are taken in and out, which are provided so as to be attachable to and removable from the main body of the image forming member 100.

Furthermore, as is illustrated in FIG. 3, the frame member 200 has lower left plates 207*a* and 207*b* which limit positions in the depth direction of the left column 205 and the rear face plate 202, in the vicinity of the installation surface of the main body of the image forming member 100. The lower left plates 207*a* and 207*b* serve as the rail member for guiding the feeding cassettes 101*a* and 101*b* when the cassettes are taken in and out, which are provided so as to be attachable to and removable from the main body of the image forming member 100.

Furthermore, as is illustrated in FIG. 3, the frame member 200 has a lower front stay 208 which is a beam member and is a first support member that limits positions in the width direction of the right column 204 and the left column 205, in the vicinity of the installation surface of the main body of the image forming member 100. The lower front stay 208 (a first stay) and the right column 204 (a second stay) are arranged so as to be approximately vertical to each other, and the lower front stay 208 (the first stay) and the left column 205 (the third stay) are arranged so as to be approximately vertical to each other.

Furthermore, as is illustrated in FIG. 4, the frame member 200 has a back bottom stay 212, which is formed integrally with the back face plate 202. The back bottom stay 212 is bent in the vicinity of the installation surface of the main body of the image forming member 100 and forms a bottom portion in the back side of the main body of the image forming member 100. Furthermore, as is illustrated in FIG. 4, the frame member 200 has a lower left stay 211, which connects the left column 205 with the back bottom stay 212, in the vicinity of the installation surface of the main body of the image forming member 100. Furthermore, as is illustrated in FIG. 3 and FIG. 4, the frame member 200 has an upper left stay 210, which connects the left column 205 with the rear face plate 202, at the upper part of the left column 205.

Furthermore, as is illustrated in FIG. 3 and FIG. 4, the frame member 200 has an upper right stay 209 for limiting positions in the depth direction of the right column 204 and the rear face plate 202, at the upper end portion of the right column 204. Furthermore, as is illustrated in FIG. 4, the frame member 200 has a middle left stay 213 for limiting positions in the depth direction of the left column 205 and the rear face plate 202, at a middle portion of the left column 205. Furthermore, as is illustrated in FIG. 3, the frame member 200 has a middle right stay 214 for limiting positions in the depth direction of the right column 204 and the rear face plate 202, at a middle portion of the right column 204.

Furthermore, as is illustrated in FIG. 3, the frame member 200 is structured to have an upper front stay 215 which is a beam member and is a fourth stay for limiting positions in the width direction of the left column 205 and the right column 204, at the upper part of the left column 205. The upper front stay 215 (a fourth stay) is arranged so as to be approximately parallel to the lower front stay 208 (the first stay). The upper front stay 215 (the fourth stay) and the right column 204 (the second stay) are arranged so as to be approximately vertical to each other. The upper front stay 215 (the fourth stay) and the left column 205 (the third stay) are also arranged so as to be approximately vertical to each other.

The image forming member 100 in the present embodiment is provided with two stages of feeding cassettes 101*a* and 101*b* in upper and lower sides so as to be drawable from the main body of the image forming member 100, as is illustrated in FIG. 1 and FIG. 2. As is illustrated in FIG. 3, a lower front opening A is provided in a space between the front face plate 201 and the lower front stay 208, into which the feeding cassettes 101*a* and 101*b* are inserted so as to be drawable.

In addition, the conveyance path 105 which conveys the recording material 1 therethrough is provided in the right side of FIG. 2 of the main body of the image forming member 100 in the present embodiment. In the case where a jam has occurred in the recording material 1 that is conveyed through the conveyance path 105, a user accesses the conveyance path 105 in order to perform jam processing. A right face opening D illustrated in FIG. 3 is provided so that the user accesses the conveyance path 105 and performs the jam processing.

FIG. 5 is an explanatory bottom view illustrating a structure of the frame member 200 at the time when the main body of the image forming member 100 in the present embodiment has been viewed from a bottom face side. As is illustrated in FIG. 5, the bottom portion of the image forming member 100 is structured to have the lower front stay 208, the lower left stay 211 and the back bottom stay 212.

As is illustrated in FIG. 5, in the lower front stay 208, the lower left stay 211 and the back bottom stay 212, three portions of supporting portions 220*a* to 220*c* which support the main body of the image forming member 100 are provided on the bottom portion side of the main body of the image forming member 100, so as to project therefrom. Thereby, the three portions of the supporting portions 220*a* to 220*c* are structured so as to receive a load of the main body of the image forming member 100.

The three portions of the supporting portions 220*a* to 220*c* will be described below which are arranged on the lower front stay 208, the lower left stay 211 and the back bottom stay 212, so as to project therefrom. The supporting portions 220*a* and 220*b* which are arranged on the lower front stay 208 and the back bottom stay 212 so as to project therefrom, respectively, are provided in the vicinity of a corner in a front right side and in the vicinity of a corner in a back right side of the bottom portion of the main body of the image forming member 100, respectively, so as to sandwich the conveyance path 105 illustrated in FIG. 2.

As is illustrated in FIG. 5, the supporting portion 220*c* which is provided on the lower left stay 211 so as to project therefrom is arranged in the vicinity of the center of the left end of the bottom portion of the main body of the image forming member 100 so that a gravity G of the main body of the image forming member 100 is arranged in the inside of an approximate triangle which connects three portions of the supporting portions 220*a* to 220*c* to each other.

In the main body of the image forming member 100, a driving section and an electrical equipment section which are heavy articles are provided on the back side of the main body of the image forming member 100. In addition, the conveyance path 105 that conveys the recording material 1 therethrough and is a heavy article is provided in the right side of the main body of the image forming member 100, which is illustrated in FIG. 2. Because of this, the gravity G of the main body of the image forming member 100 is positioned in a more back and right side than the center of the main body of the image forming member 100, as is illustrated in FIG. 5.

Specifically, the gravity G of the image forming member 100 exists in a position which is closest to the supporting portion 220*b* in the back right side, among the three portions of the supporting portions 220*a* to 220*c* in the bottom portion of the main body of the image forming member 100, which are illustrated in FIG. 5.

When the main body of the image forming member 100 in the present embodiment is installed on the floor surface alone without being equipped with the optional feeding module 150 illustrated in FIG. 1, the three supporting portions 220*a* to 220*c* in the bottom portion of the main body of the image forming member 100, which are illustrated in FIG. 5, are grounded directly on the floor surface. At this time, an upstanding attitude of the main body of the image forming member 100 is determined by the heights of the three portions of the supporting portions 220*a* to 220*c* in the bottom portion. Even when the flatness of the floor surface is poor at a place on which the main body of the image forming member 100 is installed, the main body of the image forming member 100 is not tilted, twisted and distorted, if the heights of the supporting portions 220*a* to 220*c* are appropriately adjusted.

<First Stay>

Figures 6A, 6B:
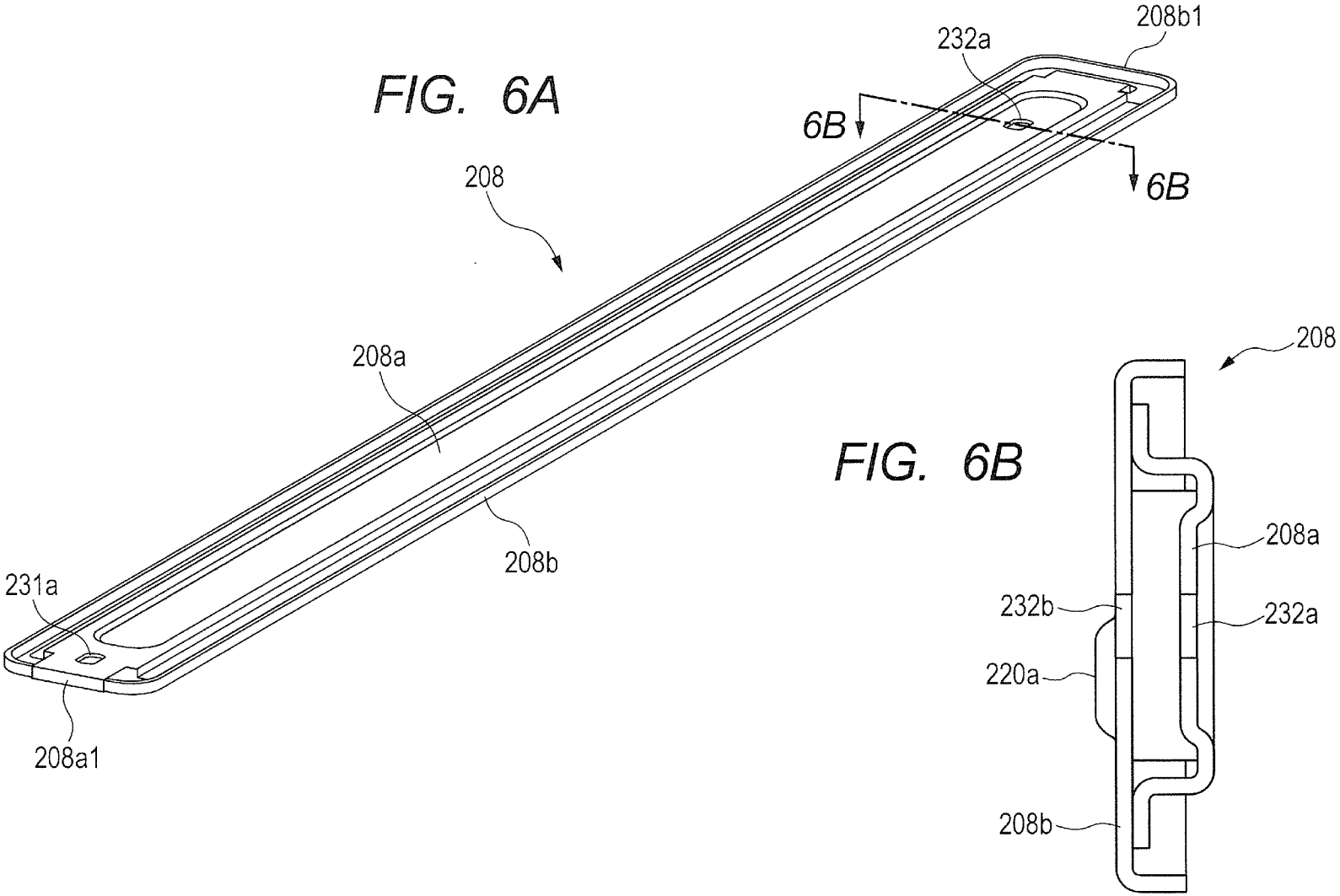
FIG. 6A is an explanatory perspective view illustrating a structure of a first stay.
FIG. 6B illustrates a 6B-6B cross section of the first stay in FIG. 6A.
Figure 7A:
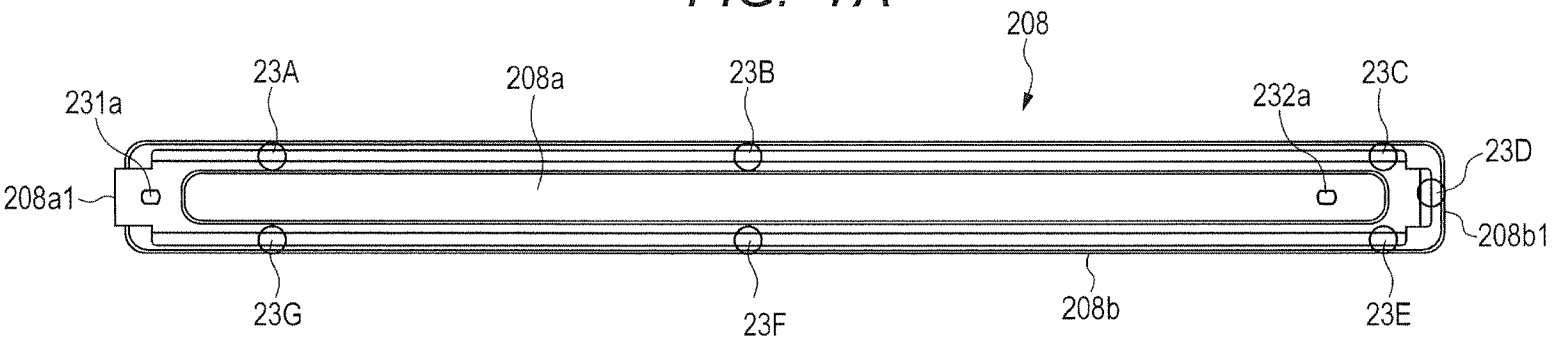
FIG. 7A is an explanatory plan view illustrating the structure of the first stay.
Figure 7B:
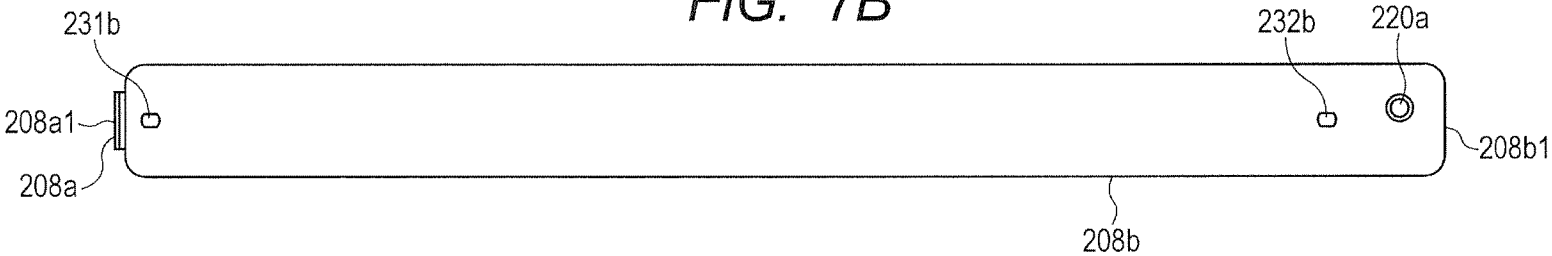
FIG. 7B is an explanatory bottom view illustrating the structure of the first stay.

Next, the structure of the lower front stay 208 which is the first stay (the first support member) will be described below with reference to FIGS. 6A and 6B and FIGS. 7A and 7B. FIG. 6A is an explanatory perspective view illustrating a structure of the lower front stay 208. FIG. 6B is a 6B-6B cross-sectional view of FIG. 6A which illustrates a structure of the lower front stay 208. FIG. 7A is an explanatory plan view illustrating the structure of the lower front stay 208. FIG. 7B is an explanatory bottom view illustrating the structure of the lower front stay 208.

As is illustrated in FIGS. 6A and 6B and FIGS. 7A and 7B, the lower front stay 208 is structured by a first member 208*a* having a hat-shaped cross-section and a second member 208*b* having a U-shaped cross-section which are joined to each other. As is illustrated in FIG. 7A, the first member 208*a* and the second member 208*b* are fastened to each other by being welded at welding points 23A to 23G. Thereby, as is illustrated in FIG. 6B, the cross section of the first member 208*a* and the second member 208*b* is formed as an integrally and continuously closed cross-section.

In the present embodiment, the first member 208*a* and the second member 208*b* shall have been fastened by a welding method, but the first member 208*a* and the second member 208*b* may be fastened to each other by another method such as screw fastening.

When the cross section of the first member 208*a* and the second member 208*b* is formed as the integrally and continuously closed cross-section, as is illustrated in FIG. 6B, a geometrical moment of inertia can be thereby increased. In addition, the geometrical moment of inertia of the lower front stay 208 is a value which shows a level at which the lower front stay 208 resists deformation against a bending moment. Thereby, the deformation of the lower front stay 208, which is caused by a weight of the main body of the image forming member 100, can be greatly suppressed.

As is illustrated in FIG. 6A and FIG. 7A, the first member 208*a* is provided with long holes 231*a* and 232*a* which are formed of through holes that are long in a longitudinal direction (horizontal direction in FIG. 7A) of the first member 208*a*. In addition, the second member 208*b* is provided with long holes 231*b* and 232*b* which are formed of through holes that are long in a longitudinal direction (horizontal direction in FIG. 7B) of the second member 208*b*, at positions corresponding to the long holes 231*a* and 232*a* which are provided in the first member 208*a*. As is illustrated in FIG. 5, FIG. 6B and FIG. 7B, in the second member 208*b*, the supporting portion 220*a* is formed which is projected toward the bottom portion side by a drawing process.

<Fastening of First Stay to Second and Third Stays>

Figure 8:
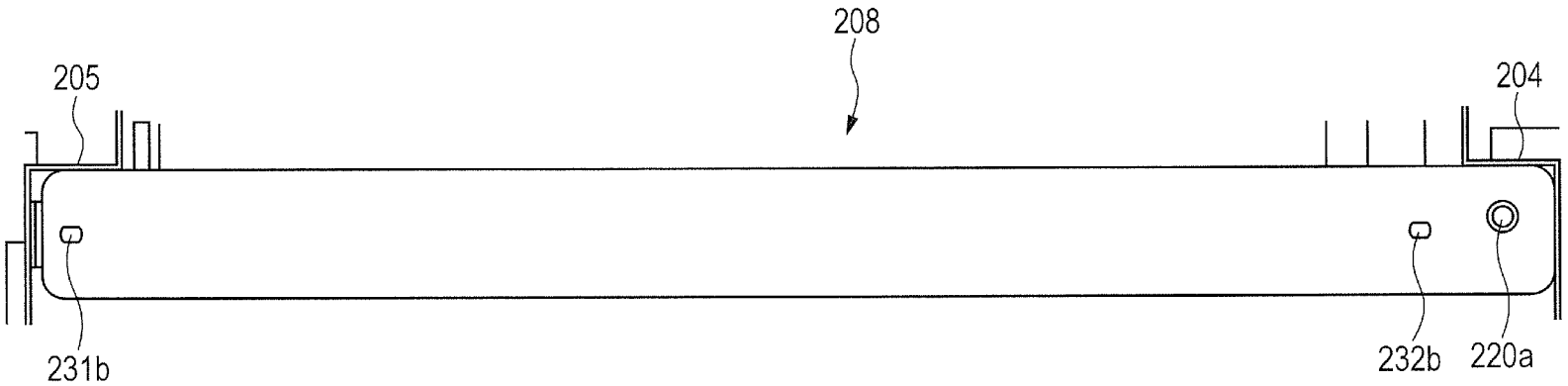
FIG. 8 is a partial bottom view at the time when the periphery of the first stay of the frame member in the main body of the image forming member is viewed from the bottom face side.
Figure 9A:
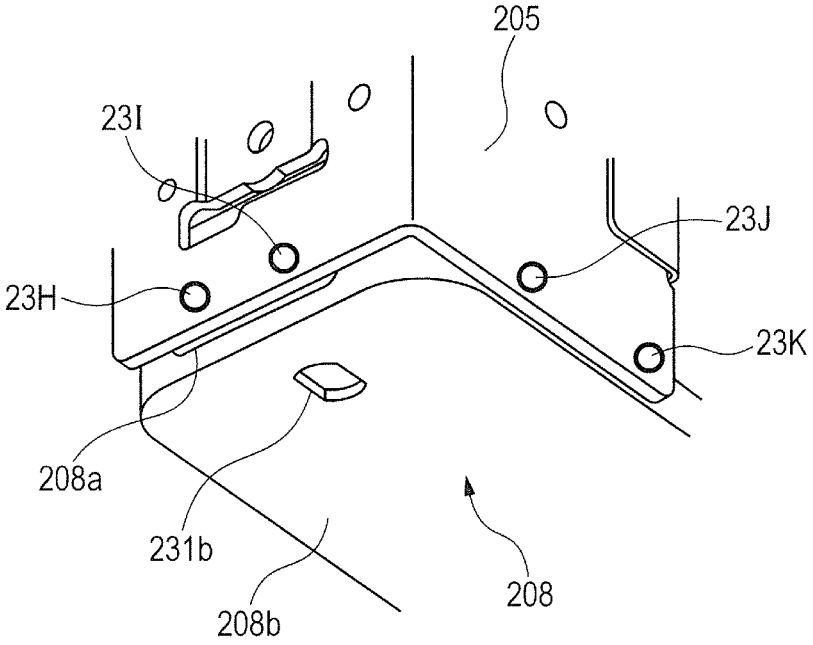
FIG. 9A is a partial perspective view illustrating a structure of a left end portion in FIG. 8.
Figure 9B:
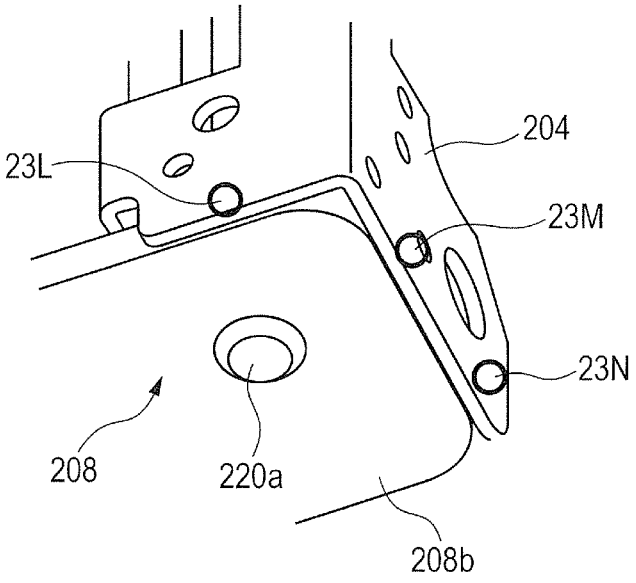
FIG. 9B is a partial perspective view illustrating a structure of a right end portion in FIG. 8.

FIG. 8 is a partial bottom view at the time when the periphery of the lower front stay 208 of the frame member 200 in the main body of the image forming member 100 has been viewed from the bottom side. FIG. 9A is a partial perspective view illustrating a structure of a left end portion of FIG. 8. FIG. 9B is a partial perspective view illustrating a structure of a right end portion of FIG. 8.

As is illustrated in FIG. 8 and FIGS. 9A and 9B, in the lower front stay 208 which is the first stay, the first member 208*a* and the second member 208*b* are fastened to each other beforehand. In the state, the lower front stay 208 is fastened to the right column 204 which is the second stay and to the left column 205 which is the third stay, each having an L-shaped cross-section, by being welded.

The perpendicular two surfaces of the outer peripheral edge of the lower front stay 208 are made to butt against each of the right column 204 and the left column 205 each having the L-shaped cross-section. Then, as is illustrated in FIGS. 9A and 9B, the lower front stay 208 is fastened to each of the right column 204 and the left column 205, by being welded at the welding points 23H to 23N. The lower front stay 208 (the first stay) is fastened to the right column 204 (the second stay) and the left column 205 (the third stay) by welding.

As is illustrated in FIG. 9A, the first member 208*a* of the lower front stay 208 is laser-welded to and fastened to the left column 205 at the welding points 23H to 23K. In addition, as is illustrated in FIG. 9B, the second member 208*b* of the lower front stay 208 is laser-welded to and fastened to the right column 204 at the welding points 23L to 23N. Thereby, the space between the right column 204 and the left column 205 is determined by the dimension in the longitudinal direction (horizontal direction in FIG. 8) of the lower front stay 208 illustrated in FIG. 8.

<Adjustment of Dimension in Longitudinal Direction of Lower Front Stay>

Figure 10A:
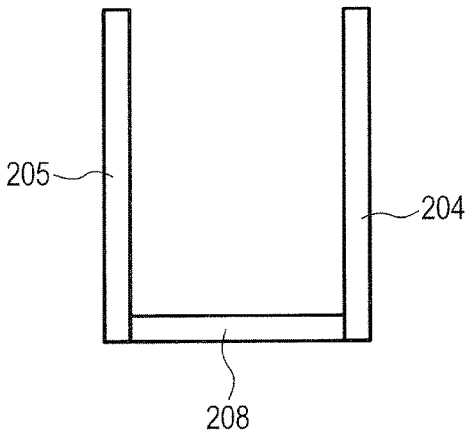
FIG. 10A is a schematic view illustrating a space between a second stay and a third stay, and an upstanding attitude, in the case where the first stay is structured according to a specified dimension which is a dimension in a longitudinal direction.
Figure 10B:
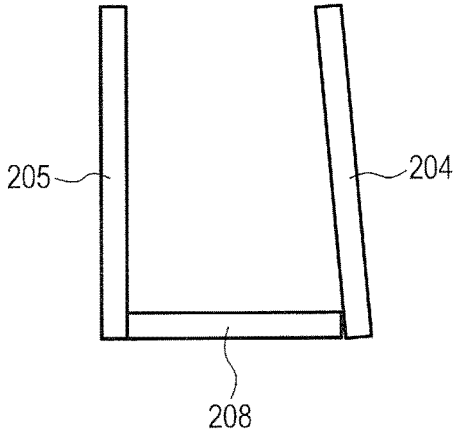
FIG. 10B is a schematic view illustrating one example of a space between the second stay and the third stay and an upstanding attitude, in the case where the first stay is structured according to in the longitudinal direction, which is longer than the specified dimension.

Next, necessity for the adjustment of a dimension in the longitudinal direction of the lower front stay 208 will be described below with reference to FIGS. 10A to 10D. FIG. 10A is a schematic view illustrating a space between the right column 204 and the left column 205 and the upstanding attitudes of the columns, in the case where the lower front stay 208 is structured according to a specified dimension which is a dimension in a longitudinal direction. FIG. 10B is a schematic view illustrating one example of a space between the right column 204 and the left column 205 and upstanding attitudes of the columns, in the case where the lower front stay 208 is structured according to a dimension in the longitudinal direction, which is longer than the specified dimension.

Figure 10C:
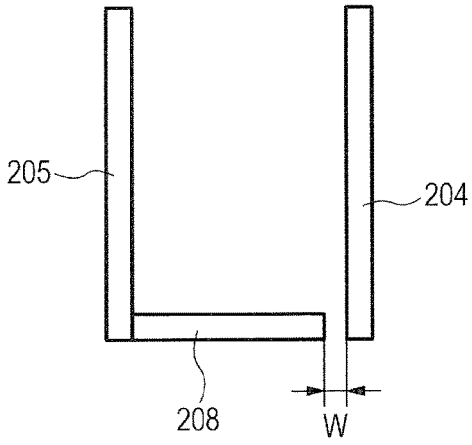
FIG. 10C is a schematic view illustrating one example of a space between the second stay and the third stay and an upstanding attitude, in the case where the first stay is structured according to in the longitudinal direction, which is shorter than the specified dimension.
Figure 10D:
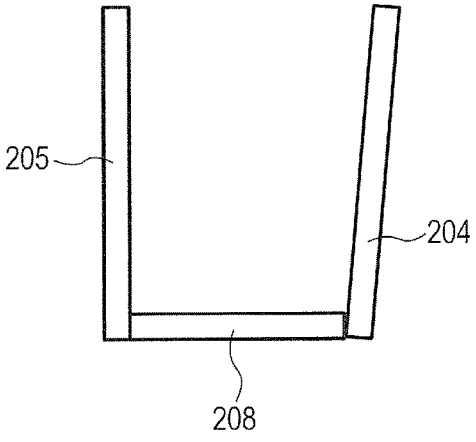
FIG. 10D is a schematic view illustrating another example of a space between the second stay and the third stay and an upstanding attitude, in the case where the first stay is structured according to in the longitudinal direction, which is shorter than the specified dimension.

FIG. 10C is a schematic view illustrating one example of a space between the right column 204 and the left column 205 and the upstanding attitudes of the columns, in the case where the lower front stay 208 is structured according to a dimension in the longitudinal direction, which is shorter than the specified dimension. FIG. 10D is a schematic view illustrating another example of a space between the right column 204 and the left column 205 and the upstanding attitudes of the columns, in the case where the lower front stay 208 is structured according to a dimension in the longitudinal direction, which is shorter than the specified dimension.

As has been described with reference to FIG. 8 and FIGS. 9A and 9B, the dimension in the longitudinal direction of the lower front stay 208 determines the space between the right column 204 and the left column 205. When the lower front stay 208 is formed according to a specified dimension (nominal dimension) which is a dimension in the longitudinal direction, the right column 204 and the left column 205 are arranged so that the space therebetween becomes a space of the specified dimension (nominal dimension) in the longitudinal direction of the lower front stay 208, as is illustrated in FIG. 10A.

However, there is a case where the dimension in the longitudinal direction of the lower front stay 208 is shorter than the specified dimension (nominal dimension), and where one end portion in the longitudinal direction of the lower front stay 208 butts against the left column 205. In this case, a gap W results in being formed between the right column 204 and the other end portion in the longitudinal direction of the lower front stay 208, as is illustrated in FIG. 10C, or the right column 204 results in tilting, as is illustrated in FIG. 10D.

In addition, when the dimension in the longitudinal direction of the lower front stay 208 is longer than the specified dimension (nominal dimension), and one end portion in the longitudinal direction of the lower front stay 208 butts against the left column 205, the right column 204 results in tilting, as is illustrated in FIG. 10B.

In addition, similarly, when one end portion in the longitudinal direction of the lower front stay 208 butts against the right column 204, the left column 205 becomes similar states to those of the right column 204, which are illustrated in FIGS. 10B to 10D.

When the right column 204 and/or the left column 205 result in tilting, as are illustrated in FIG. 10B and FIG. 10D, the image forming unit 103, the conveyance path 105 and the like in the inside of the main body of the image forming member 100 illustrated in FIG. 2 result in being twisted. Then, there is a possibility that the twisting results in disturbing the adequate image formation and the conveyance of the recording material 1.

In addition, as is illustrated in FIG. 10C, there is a case where the gap W results in being formed between the end portion in the longitudinal direction of the lower front stay 208 and the right column 204. For instance, in the present embodiment, when the gap W between the end portion in the longitudinal direction of the lower front stay 208 and the right column 204, which is illustrated in FIG. 10C, becomes 0.3 mm or longer, the following circumstance will be occur. When the lower front stay 208 and the right column 204 are fastened to each other by laser welding, such a possibility becomes high that a welding failure occurs.

When a dimension of a part to be bent of the component is adjusted and then a dimension in the longitudinal direction is determined, as in the above described Japanese Patent Application Laid-Open No. 2010-204247, in the case of a sheet metal having a length of approximately 500 mm, the sheet metal generally has a dimension tolerance (approximately ±0.5 mm to ±0.7 mm). Because of this, when it is intended to lessen the dimension tolerance of the component, it becomes necessary to inspect all of the components, a fraction defective increases, and the cost of the component results in increasing.

Figure 11:
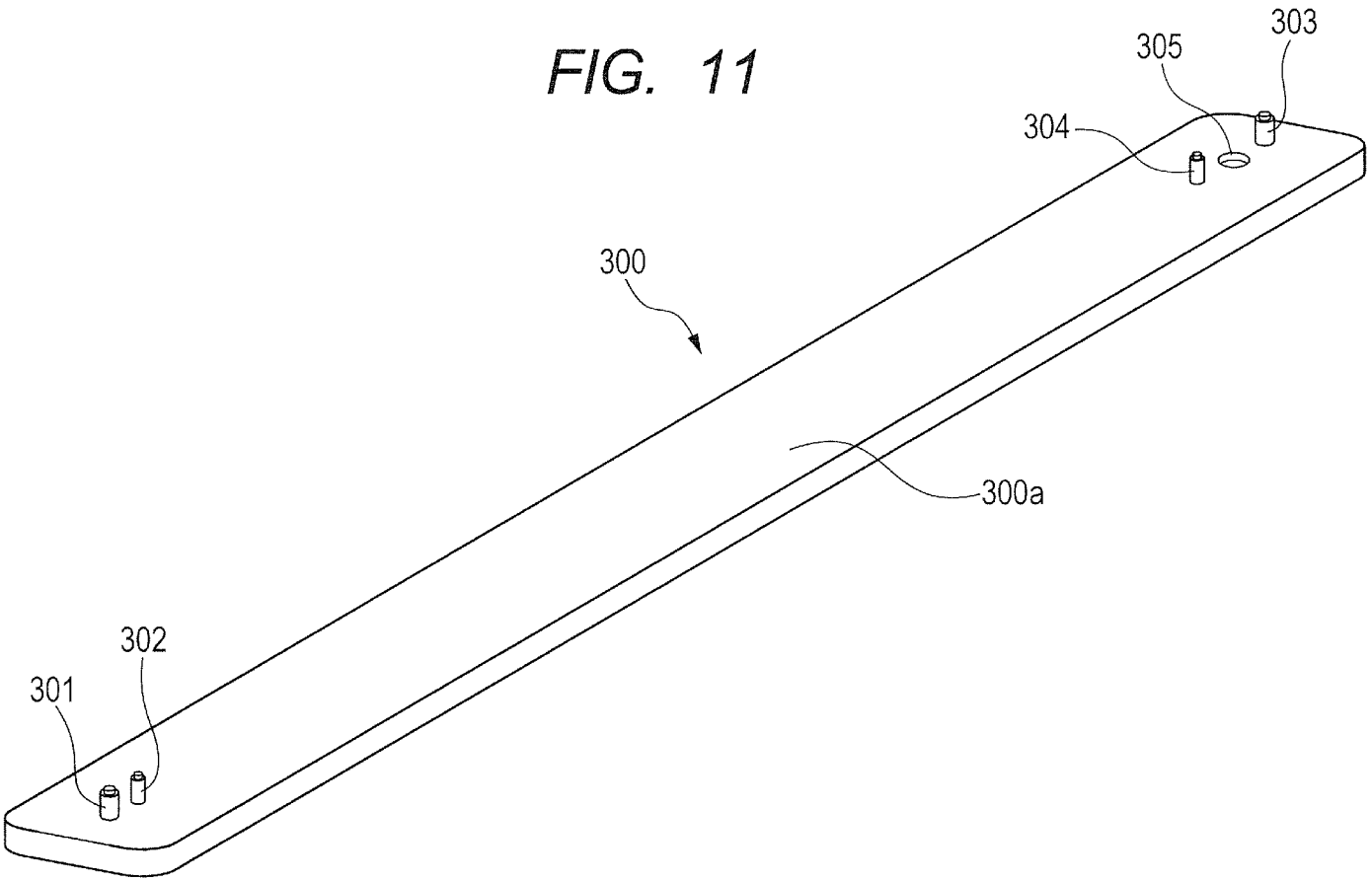
FIG. 11 is an explanatory perspective view illustrating a structure of a tool for adjusting the dimension in the longitudinal direction of the first stay.
Figure 12:
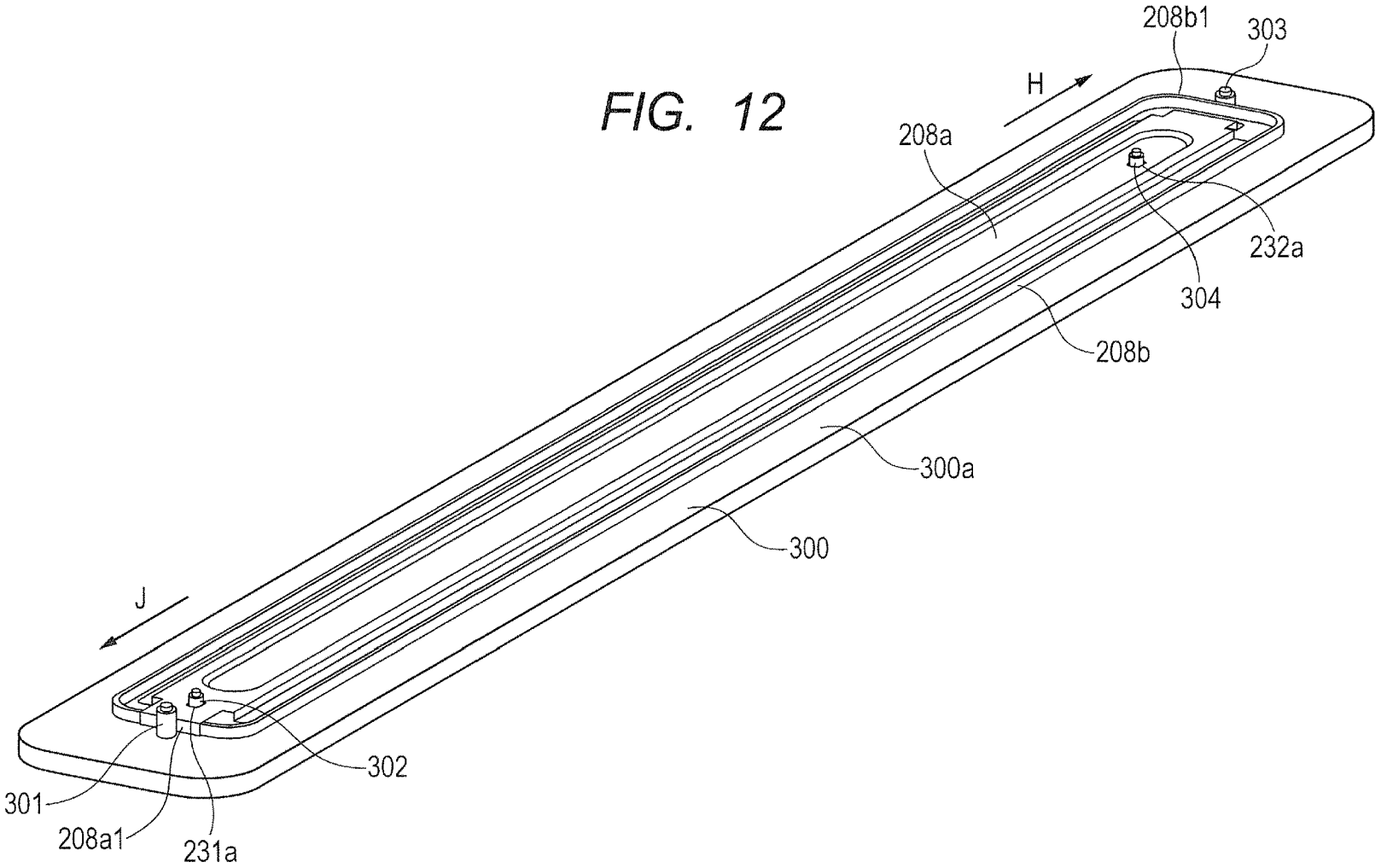
FIG. 12 is an explanatory perspective view illustrating a state in which the dimension in the longitudinal direction of the first stay is adjusted with the use of the tool.

Next, the method for adjusting the dimension in the longitudinal direction of the lower front stay 208 in the present embodiment will be described below with reference to FIG. 11 and FIG. 12. FIG. 11 is an explanatory perspective view illustrating a structure of a tool 300 for adjusting the dimension in the longitudinal direction of the lower front stay 208. FIG. 12 is an explanatory perspective view illustrating a state in which the dimension in the longitudinal direction of the lower front stay 208 is adjusted with the use of the tool 300.

As is illustrated in FIGS. 7A and 7B, the lower front stay 208 is in the following state, before the first member 208*a* and the second member 208*b* are welded to each other at the welding points 23A to 23G. The relative position between the first member 208*a* and the second member 208*b* in the longitudinal direction is not fixed so that the dimension in the longitudinal direction of the lower front stay 208 can be adjusted. The lower front stay 208 (the first stay) is formed of the first member 208*a* and the second member 208*b* which become a plurality of members that make the length in the longitudinal direction adjustable.

In the present embodiment, as is illustrated in FIG. 11, the dimension in the longitudinal direction of the lower front stay 208 can be adjusted by an operation of using the tool 300 for adjusting the dimension in the longitudinal direction of the lower front stay 208.

The tool 300 illustrated in FIG. 11 has pins 301 and 303 provided thereon which are used for determining the dimension in the longitudinal direction of the lower front stay 208 and project from the surface of a long-sized surface plate 300*a* that corresponds to the dimension in the longitudinal direction of the lower front stay 208. Furthermore, the tool 300 has pins 302 and 304 provided thereon that slidably penetrate long holes 231*a*, 231*b*, 232*a* and 232*b* which are provided in the first member 208*a* and the second member 208*b*, respectively, as are illustrated in FIG. 7A and FIG. 7B. In addition, the tool 300 has a relief part 305 provided therein which is formed of a through hole for getting away from the supporting portion 220*a* that is provided so as to project from the surface of the second member 208*b*, as is illustrated in FIG. 7B. The dimensional tolerance of the distance between the pin 301 and the pin 303 which are illustrated in FIG. 11 is adjusted to approximately ±0.03 mm beforehand.

Then, as is illustrated in FIG. 12, the first member 208*a* and the second member 208*b* are mounted and set on the surface plate 300*a* of the tool 300 illustrated in FIG. 11. At this time, the second member 208*b* is mounted on the surface plate 300*a* of the tool 300 illustrated in FIG. 12. Then, the pins 302 and 304 which are installed vertically on the surface plate 300*a* of the tool 300 are inserted into the long holes 231*b* and 232*b* which are provided in the second member 208*b* and are illustrated in FIG. 8, so as to be slidable along the long holes 231*b* and 232*b*.

On the other hand, as is illustrated in FIG. 12, the first member 208*a* is mounted on the second member 208*b* so as to freely slide along the longitudinal direction of the second member 208*b*. Then, the pins 302 and 304 which are installed vertically on the surface plate 300*a* of the tool 300 are inserted into the long holes 231*a* and 232*a* that are provided on the first member 208*a* and are illustrated in FIG. 7A, so as to be slidable along the long holes 231*a* and 232*a*.

The second member 208*b* which is mounted on the surface plate 300*a* of the tool 300 illustrated in FIG. 12 so as to be movable in the longitudinal direction of the surface plate 300*a* is pressed toward a direction of the arrow H in FIG. 12 by a worker or the like. At this time, the pins 302 and 304 which are installed vertically on the surface plate 300*a* of the tool 300 guide the movement of the second member 208*b* toward the direction of the arrow H in FIG. 12, in a state of being inserted into the long holes 231*b* and 232*b* that are provided in the second member 208*b* and are illustrated in FIG. 7B. An end portion 208*b*1 of the second member 208*b* butts against the pin 303 which projects upward on the surface plate 300*a*, and the position of the second member 208*b* on the surface plate 300*a* of the tool 300 is determined.

On the other hand, the first member 208*a* which has been mounted on the second member 208*b* illustrated in FIG. 12 so as to be movable in the longitudinal direction of the second member 208*b* is pressed toward the direction of the arrow J in FIG. 12 by a worker or the like. At this time, the pins 302 and 304 which are installed vertically on the surface plate 300*a* of the tool 300 guide the movement of the first member 208*a* toward the direction of the arrow J in FIG. 12, in a state of being inserted into the long holes 231*a* and 232*a* that are provided in the first member 208*a* and are illustrated in FIG. 7A. Then, an end portion 208*a*1 of the first member 208*a* butts against the pin 301 which projects upward on the surface plate 300*a*, and the position of the first stay 208*a* on the surface plate 300*a* of the tool 300 is determined.

When the first member 208*a* and the second member 208*b*, which have been illustrated in FIG. 7A and previously described, are welded at the welding points 23A to 23G of the members in this state, the dimension in the longitudinal direction of the lower front stay 208 is adjusted with extremely adequate precision. In the present embodiment, only a distribution of about ±0.05 mm occurred with respect to the specified dimension (nominal dimension) in the longitudinal direction of the lower front stay 208.

<Fourth Stay>

Figure 13A:
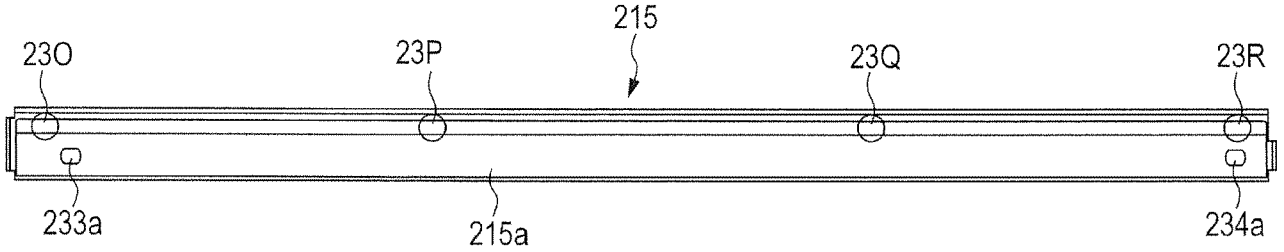
FIG. 13A is an explanatory plan view illustrating a structure of a fourth stay.
Figure 13B:
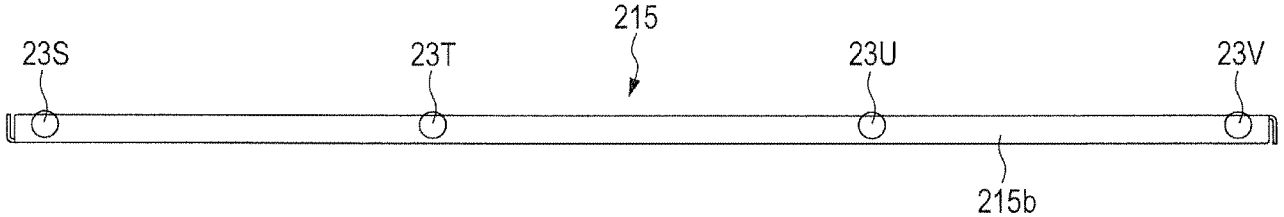
FIG. 13B is an explanatory front view illustrating the structure of the fourth stay.
Figure 13C:
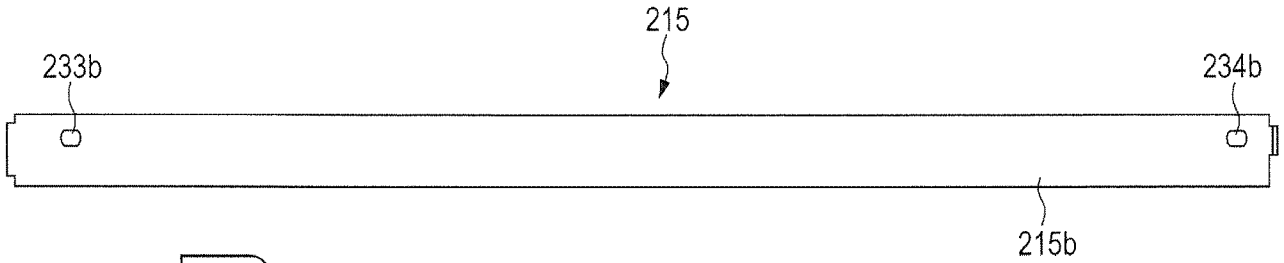
FIG. 13C is an explanatory bottom view illustrating the structure of the fourth stay.
Figure 13D:
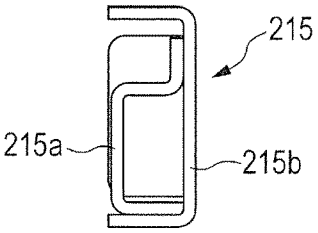
FIG. 13D is an explanatory cross-sectional view illustrating the structure of the fourth stay.

Next, a structure of the upper front stay 215 which is the fourth stay illustrated in FIG. 3 and FIG. 4 will be described below with reference to FIGS. 13A to 13D. FIG. 13A is an explanatory plan view illustrating a structure of the upper front stay 215 illustrated in FIG. 3 and FIG. 4. FIG. 13B is an explanatory front view illustrating the structure of the upper front stay 215 illustrated in FIG. 3 and FIG. 4. FIG. 13C is an explanatory bottom view illustrating the structure of the upper front stay 215 illustrated in FIG. 3 and FIG. 4. FIG. 13D is an explanatory cross-sectional view illustrating the structure of the upper front stay 215 illustrated in FIG. 3 and FIG. 4.

As is illustrated in FIGS. 13A and 13D, the upper front stay 215 has a structure in which a first stay 215*a* having a ladle-shaped cross-section and a second stay 215*b* having a U-shaped cross-section are combined and joined to each other. In addition, the first stay 215*a* and the second stay 215*b* are fastened to each other by being welded at welding points 23O to 23V, as are illustrated in FIGS. 13A and 13B. Thereby, as is illustrated in FIG. 13D, the cross section of the first stay 215*a* and the second stay 215*b* is formed as an integrally and continuously closed cross-section.

As is illustrated in FIG. 13A, the first stay 215*a* is provided with long holes 233*a* and 234*a* which are formed of through holes that are long in a longitudinal direction (horizontal direction in FIG. 13A) of the first stay 215*a*. In addition, as is illustrated in FIG. 13C, the second stay 215*b* is provided with long holes 233*b* and 234*b* which are formed of through holes that are long in a longitudinal direction (horizontal direction in FIG. 13C) of the second stay 215*b*, at positions corresponding to the long holes 233*a* and 234*a* which are provided in the first stay 215*a*.

As is illustrated in FIGS. 13A and 13B, the upper front stay 215 is in the following state, before the first stay 215*a* and the second stay 215*b* are welded to each other at the welding points 23O to 23V. The relative position between the first stay 215*a* and the second stay 215*b* in the longitudinal direction is not fixed so that the dimension in the longitudinal direction of the upper front stay 215 can be adjusted. The upper front stay 215 (fourth stay) is formed of the first stay 215*a* and the second stay 215*b* which become a plurality of members that make the length in the longitudinal direction adjustable.

In addition, as is illustrated in FIG. 3 and FIG. 4, the upper front stay 215 (fourth stay) is fastened to each of the right column 204 (second stay) and the left column 205 (third stay), by welding.

The dimension in the longitudinal direction of the upper front stay 215 can be adjusted in a similar way to the above described lower front stay 208 with the use of the tool 300 which is similar to the tool illustrated in FIG. 11. The pins 302 and 304 which are installed vertically on the surface plate 300*a* of the tool 300 are slidably inserted into the long holes 233*a* and 234*a* which are provided in the first stay 215*a* and are illustrated in FIG. 13A, and the long holes 233*b* and 234*b* which are provided in the second stay 215*b* and are illustrated in FIG. 13C, respectively. Then, the dimension in the longitudinal direction of the upper front stay 215 can be adjusted in a similar way to the above described lower front stay 208.

The dimension in the longitudinal direction of the upper front stay 215 also can be adjusted, which is arranged in parallel to the lower front stay 208, as is illustrated in FIG. 3. Thereby, the space between the right column 204 and the left column 205 can be more accurately limited than the case where only the dimension in the longitudinal direction of the lower front stay 208 is adjusted. Thereby, the frame member 200 of the main body of the image forming member 100 with high precision can be provided.

In the present exemplary embodiment, the supports 204 and 205 have been each columns. However, even when the second support and the third support are not members other than the columns, a similar effect can be obtained. The first support member 208 may have such a structure that the first support member 208 is joined to a plate member which functions as a second support member, by welding, and is joined to a stay which functions as a third support member, by welding.

In addition, the first support member 208 may have such a structure that the first support member 208 is joined to the plate member which functions as the second support member, by welding, and is joined to a plate member which functions as the third support member, by welding.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-169069, filed Aug. 28, 2015, which is hereby incorporated by reference herein in its entirety.

What is claimed is:

1. A method of manufacturing an image forming apparatus comprising a frame configured to support an image forming unit, the frame including (a) a first column member, (b) a second column member, and (c) a connecting unit configured to connect the first column member and the second column member, the connecting unit including (i) a first member including a welding surface that is disposed at a portion of the first member closer to one end of the connecting unit than a center of the connecting unit in a longitudinal direction of the connecting unit, (ii) a second member including a welding surface that is disposed at a portion of the second member closer to another end of the connecting unit than the center of the connecting unit in the longitudinal direction of the connecting unit, the method comprising:

adjusting a length between the welding surface of the first member and the welding surface of the second member to a predetermined distance by relatively sliding the first member and the second member in the longitudinal direction;

fixing the first member and the second member after the length between the welding surface of the first member and the welding surface of the second member is adjusted in the step of adjusting the length;

welding the welding surface of the first member with the first column member; and welding the welding surface of the second member with the second column member.

2. The method of manufacturing an image forming apparatus according to claim 1, wherein the first member has a first long hole extending in a longitudinal direction of the connecting unit, and the second member has a second long hole extending in a longitudinal direction of the connecting unit, and wherein the adjusting of the length between the welding surface of the first member and the welding surface of the second member further includes:

inserting a positioning pin provided on an adjustment device into the first long hole and the second long hole; and sliding the first member and the second member relative to each other in the longitudinal direction to adjust the length between the welding surface of the first member and the welding surface of the second member.

3. The method of manufacturing an image forming apparatus according to claim 2, wherein the fixing of the first member and the second member is performed further includes laser welding the first member and the second member to each other in a condition where the positioning pin is inserted into the first long hole and the second long hole.

4. The method of manufacturing an image forming apparatus according to claim 1, wherein welding the welding surface of the first member with the first column member includes laser welding the welding surface of the first member and the first column member to each other, and wherein welding the welding surface of the second member with the second column member includes laser welding the welding surface of the second member and the second column member to each other.

5. The method of manufacturing an image forming apparatus according to claim 1, wherein the welding surface of the first member is provided at a first end in a longitudinal direction of the connecting unit, wherein the welding surface of the second member is provided at a second end that is opposite to the first end in a longitudinal direction of the connecting unit, wherein the first column member is a stay including an L-shaped cross section part, the first column member having a first surface opposing the first end and a second surface extending along the longitudinal direction, wherein the second column member is a stay including an L-shaped cross section part, the second column member having a third surface opposing the second end and a fourth surface extending along the longitudinal direction, wherein in the adjusting of the length to the predetermined distance, the length between the welding surface of the first member and a welding surface of the second member is defined as a length between the first end and the second end, wherein welding the welding surface of the first member with the first column member includes (i) laser welding the first end with the first surface and (ii) laser welding a surface of the second member with the second surface of the first column member, and wherein welding the welding surface of the second member with the second column member includes (i) laser welding the second end with the third surface and (ii) laser welding a surface of the second member is with the fourth surface of the second column member.

6. An image forming apparatus comprising:

the frame manufactured by the method of claim 1; and the image forming unit supported by the frame.

* * * * *